US006135253A

United States Patent [19]

Weissman et al.

[11] Patent Number: 6,135,253

[45] Date of Patent: Oct. 24, 2000

[54] SUITCASE WITH COMPRESSIBLE PACKING SYSTEM

[76] Inventors: Ira B. Weissman; Helaine R. Weissman, both of 2441 SW. 22nd St., Miami, Fla. 33145

[21] Appl. No.: 09/382,058

[22] Filed: Aug. 24, 1999

[51] Int. Cl.[7] ..... A45C 5/12; A45C 13/02

[52] U.S. Cl. ..... 190/36; 190/110; 190/125; 206/292; 206/524.8

[58] Field of Search ..... 190/36, 100, 103, 190/107, 35; 206/206, 524.8, 278, 292, 524.7; 383/3

[56] References Cited

U.S. PATENT DOCUMENTS

| | | | |
|---|---|---|---|
| 159,284 | 2/1875 | Coit | 190/36 |
| 645,980 | 3/1900 | Smith | 190/36 |
| 1,713,558 | 5/1929 | Schollmeyer | 206/524.8 |
| 3,570,570 | 3/1971 | Winner | 190/35 |
| 3,587,794 | 6/1971 | Mattel | 383/3 X |
| 4,155,453 | 5/1979 | Ono | 383/3 X |
| 4,262,801 | 4/1981 | Avery | 383/3 X |
| 5,011,729 | 4/1991 | McAllister | 206/524.8 X |
| 5,195,620 | 3/1993 | Tate | 190/36 |
| 5,246,114 | 9/1993 | Underwood | 383/3 X |
| 5,485,921 | 1/1996 | Tolendano | 206/524.8 X |
| 5,881,881 | 3/1999 | Carrington | 383/3 X |

*Primary Examiner*—Sue A. Weaver
*Attorney, Agent, or Firm*—Robert M. Downey, PA

[57] ABSTRACT

A suitcase is provided with a compressive liner encapsulating an air tight packing chamber and having a sealable opening to allow placement and removal of clothing and other articles within the packing chamber. In a relaxed state, the volume of the packing chamber is substantially greater than the volume of the suitcase interior, thereby enlarging the available packing space. When the liner is filled and sealed closed, air is withdrawn from the packing chamber by a motorized vacuum pump, causing the liner to collapse and compress the contents, thereby reducing the volume of the packing chamber to a size which fits within the closed suitcase. A one-way valve holds the vacuum within the chamber, maintaining the liner in the collapsed state until the opening is unsealed.

14 Claims, 5 Drawing Sheets

SUITCASE WITH COMPRESSIBLE PACKING SYSTEM

BACKGROUND OF THE INVENTION

1. Field of the Invention

The present invention relates to collapsible storage structures and, more particularly, to a suitcase having an air tight liner which collapses to compress bulky articles such as clothing, thereby increasing the storage capacity of the suitcase.

2. Description of the Related Art

When travelling, the transport of luggage can often be a burdensome ordeal. And, despite the difficulty and inconvenience of having to tote heavy suitcases throughout one's journey, many air travelers prefer to carry their luggage on the plane in order to avoid delays at their destination. In recent years, however, many airlines have implemented strict policies, limiting the size and number of pieces of luggage which can be carried on the plane. Unfortunately, it is not always easy to fit all of one's items in a small suitcase. Luggage pieces which do not meet the carry-on size limitations must be checked with the airline for storage in the plane's cargo compartments. In addition to delays encountered when waiting for checked luggage, as well as the possibility of loosing the luggage, an oversize suitcase is difficult to carry and transport, especially when travelling to more than one destination.

In a desperate attempt to pack more clothing and articles in a smaller suitcase, virtually every traveler has encountered the inevitable battle of zipping closed an overstuffed suitcase. This is a particularly common dilemma for those travelling to colder climates, such as ski destinations, wherein the packed articles of clothing tend to be bulky, such as sweaters, jackets, ski suits, and the like.

In the past, others have developed collapsible storage containers which typically include a flexible, air tight bag, and a fixture through which to evacuate excess air. When the air tight bag has been filled with one or more articles, air is evacuated through the fixture, causing the bag to collapse, thereby compressing the articles therein so that the storage container is easier to transport and store in a smaller space.

One such storage container is disclosed in U.S. Pat. No. 5,480,030 to Sweeney, et al. This patent discloses a reusable, evacuable enclosure comprising a bag with an opening in which to place compressible articles, such as clothing or linen, and a one-way valve in a surface of the bag. Excess air in the bag is removed by replacing a cylindrical attachment of a household vacuum cleaner over the one-way valve. Once the excess air is extracted, a cap is placed over the valve to ensure a permanent seal. Removal of the excess air reduces the size of the compressible article inhibits the growth of insects and bacteria, which may damage the contents of the bag. Generally, the enclosure structure of Sweeney, et al. is intended for storing clothing, linen, and other articles for an extended period of time in a manner which prevents damage from moisture, insects, bacteria and the like, while reducing the required storage space.

Another compressible storage structure is disclosed in U.S. Pat. No. 5,540,500 to Tanaka. This patent discloses a compressive sealed bag for compressible articles such as clothing. The sealed bag includes a body of a plastic film having sealing fasteners formed at an opening portion of the bag body and a check valve formed with a flat pipe of a plastic film along any of the marginal portions of the bag body. According to the disclosure in Tanaka, the compressive sealed bag is filled with articles, such as clothing. Thereafter, the bag is sealed and air is evacuated by applying pressure to the entire bag body. Consequently, the compressible articles are compressed to a compact and thin condition while maintaining a sealed condition so that air cannot re-enter the bag.

Notwithstanding the various structures in the related art, there still exists a need for a suitcase having a collapsible packing system therein to thereby increase the holding capacity of the suitcase. More specifically, there is a need for a suitcase having a compressible packing system including a collapsible liner which is sized and configured to the interior of the suitcase, and wherein the system further includes means to remove air from the liner to thereby collapse and compress the contents therein so that the suitcase can be easily closed.

SUMMARY OF THE INVENTION

The present invention is directed to a suitcase having top and bottom portions which enclose an interior packing space, and a compressive liner fitted within the interior space. The liner is structured and disposed for containing clothing and other articles normally packed in a suitcase, and includes a sealable opening to enable placement and removal of the packed articles from within an air tight storage chamber. In a non-compressed, relaxed state, the volume of the storage chamber is substantially larger than the volume of the interior packing space of the suitcase, thereby increasing the holding capacity of the suitcase. After packing the storage chamber, the opening is sealed closed and air is removed from the storage chamber by a motorized vacuum pump, causing the liner to collapse and compress the packed articles to a volume which is less than the suitcase interior. The substantial reduction in size of the liner, when collapsed, enables the top and bottom portions of the suitcase to be easily closed. A one-way valve prevents entry of air into the storage chamber of the liner, maintaining the liner in the collapsed state, until the liner is opened when unpacking the suitcase.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
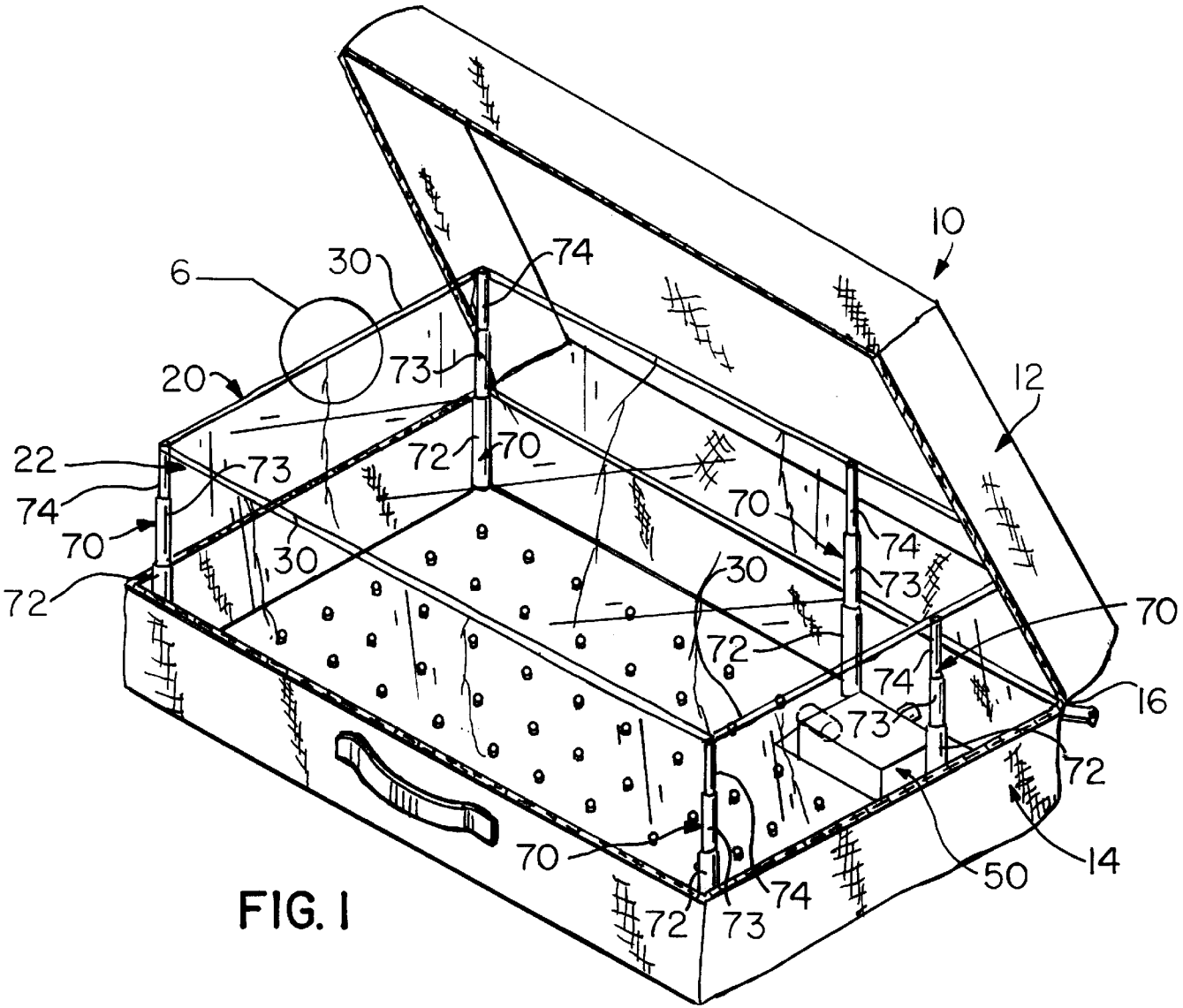
FIG. 1 is a top perspective view of the suitcase, shown in a partially open position to reveal the compressible packing system therein.
Figure 2:
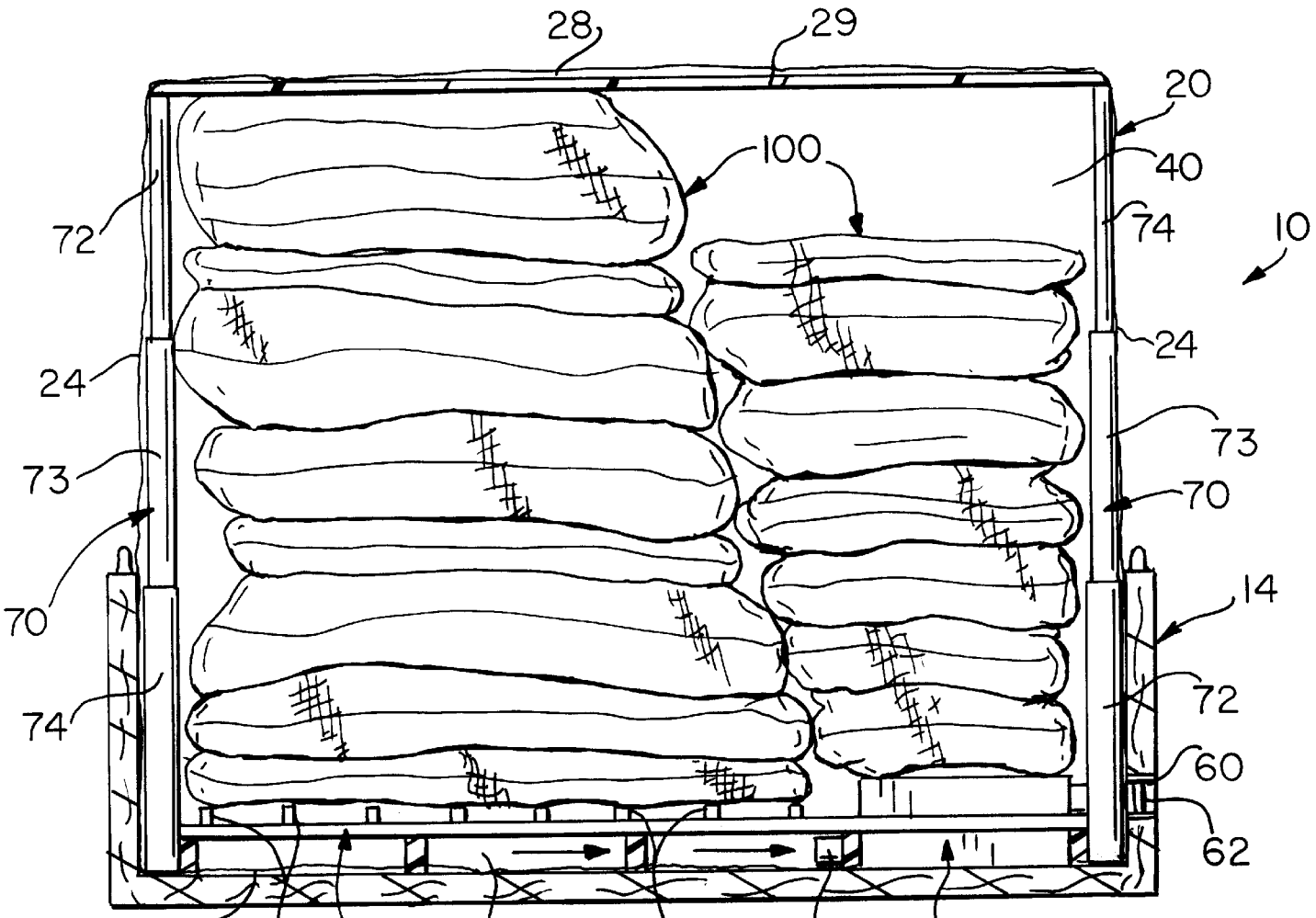
FIG. 2 is an elevational view, in partial section, showing the compressible liner in a relaxed, non-collapsed state.
Figure 3:
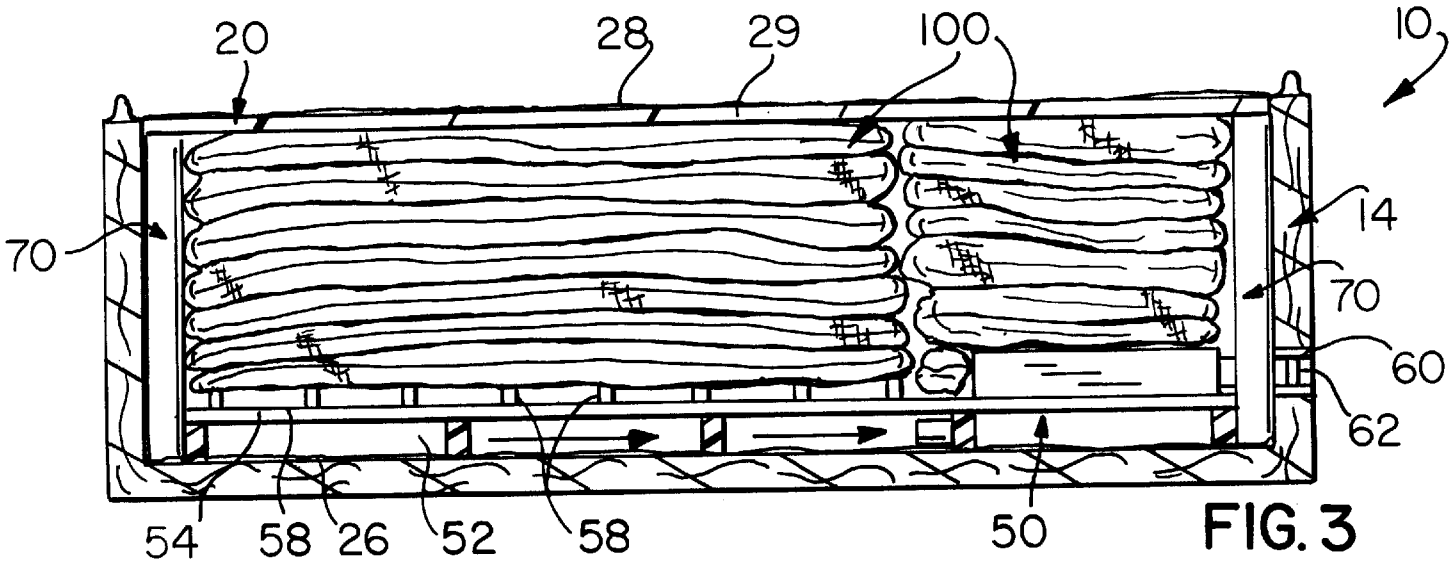
FIG. 3 is an elevational view, in partial section, showing the compressible liner in a compressed state.

Referring initially to FIGS. 1–3, a first preferred embodiment of the suitcase of the present invention is shown and generally indicated as 10. The suitcase 10 includes a top portion 12 and a bottom portion 14 which close together to enclose an interior packing space. A zipper 16 or other closure means is provided to secure the top and bottom portions in the closed position, in the same general manner as a conventional suitcase.

Figures 6, 7:
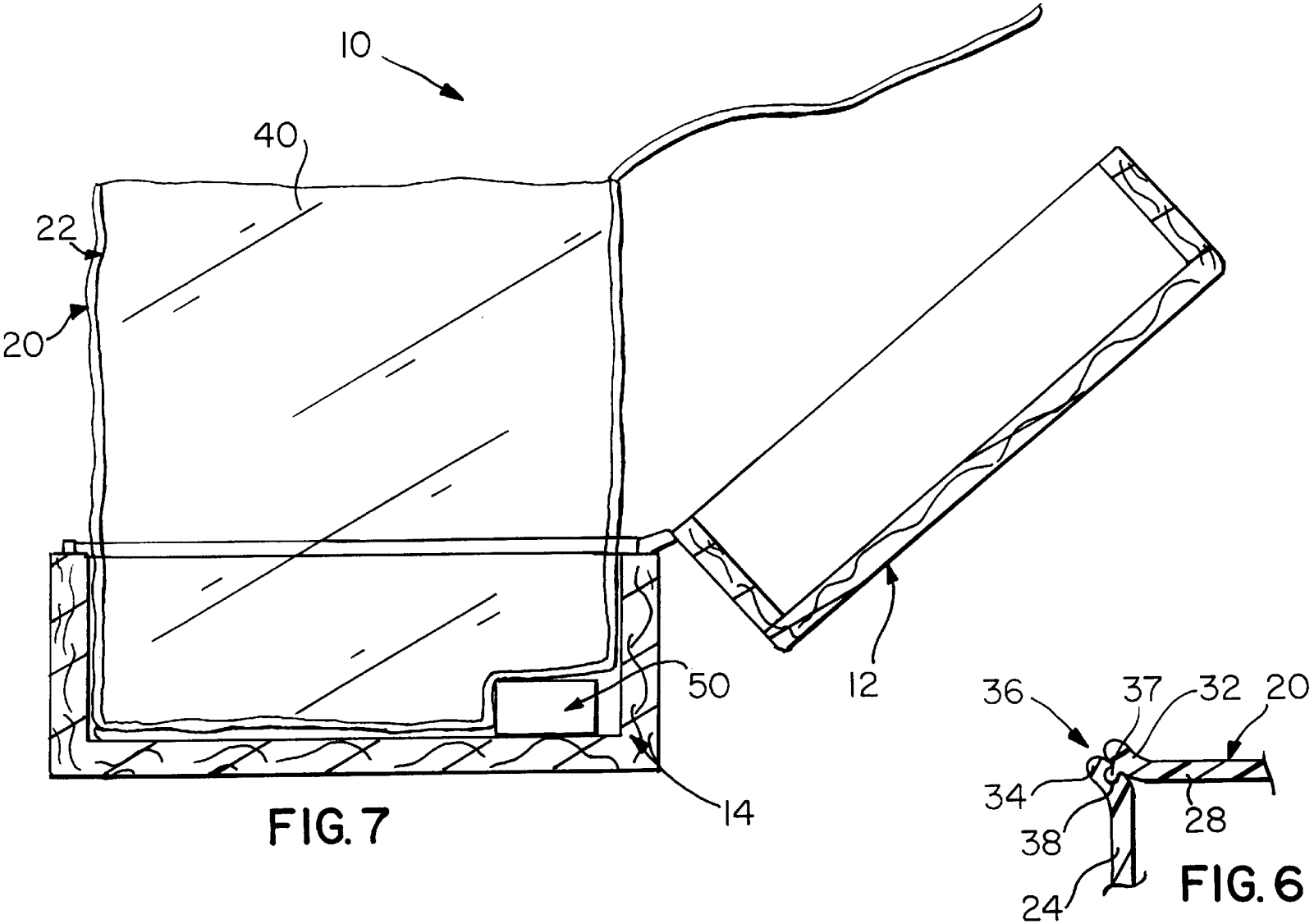
FIG. 6 is an isolated sectional view taken from the area indicated as 6 in FIG. 1, showing a seal structure for providing an air tight seal around the opening of the liner.
FIG. 7 is a side elevational view, in partial section, showing the liner in the relaxed, non-compressed state with a top of the liner in the open position.

The suitcase 10 further includes a compressible packing system, generally indicated as 20, and including a liner 22 formed of a flexible, impervious film material such as plastic or vinyl. The liner 22 includes sides 24, a bottom 26, and a top 28. In the embodiment shown in FIGS. 1–3, the top may be reinforced with a substantially rigid plate 29 which may be of a transparent material. The top 26 opens relative to the remainder of the liner about the upper peripheral side and front edges 30 of the liner, so that the top may be folded back, as generally shown in FIG. 7, to permit access to an interior packing/storage chamber 40. To secure the top in air tight relation to a remainder of the liner, air tight seal means 36 are provided, as shown in FIG. 6. Specifically, the mating peripheral lips 32, 34 of the edges 30 of the top and sides of the liner are provided with interlocking means, including a protruding ridge 37 on the peripheral lip 32 of the top of the liner and a congruently configured channel 38 formed along the opposing peripheral lip 34 of the sides of the liner. The ridge 37 is specifically structured and configured for interlocking, sealing engagement within the channel 38 to thereby provide an air tight seal about the mating peripheral edges so that when the top 38 of the liner 22 is closed, the interior storage chamber 40 is air tight.

Figure 4:
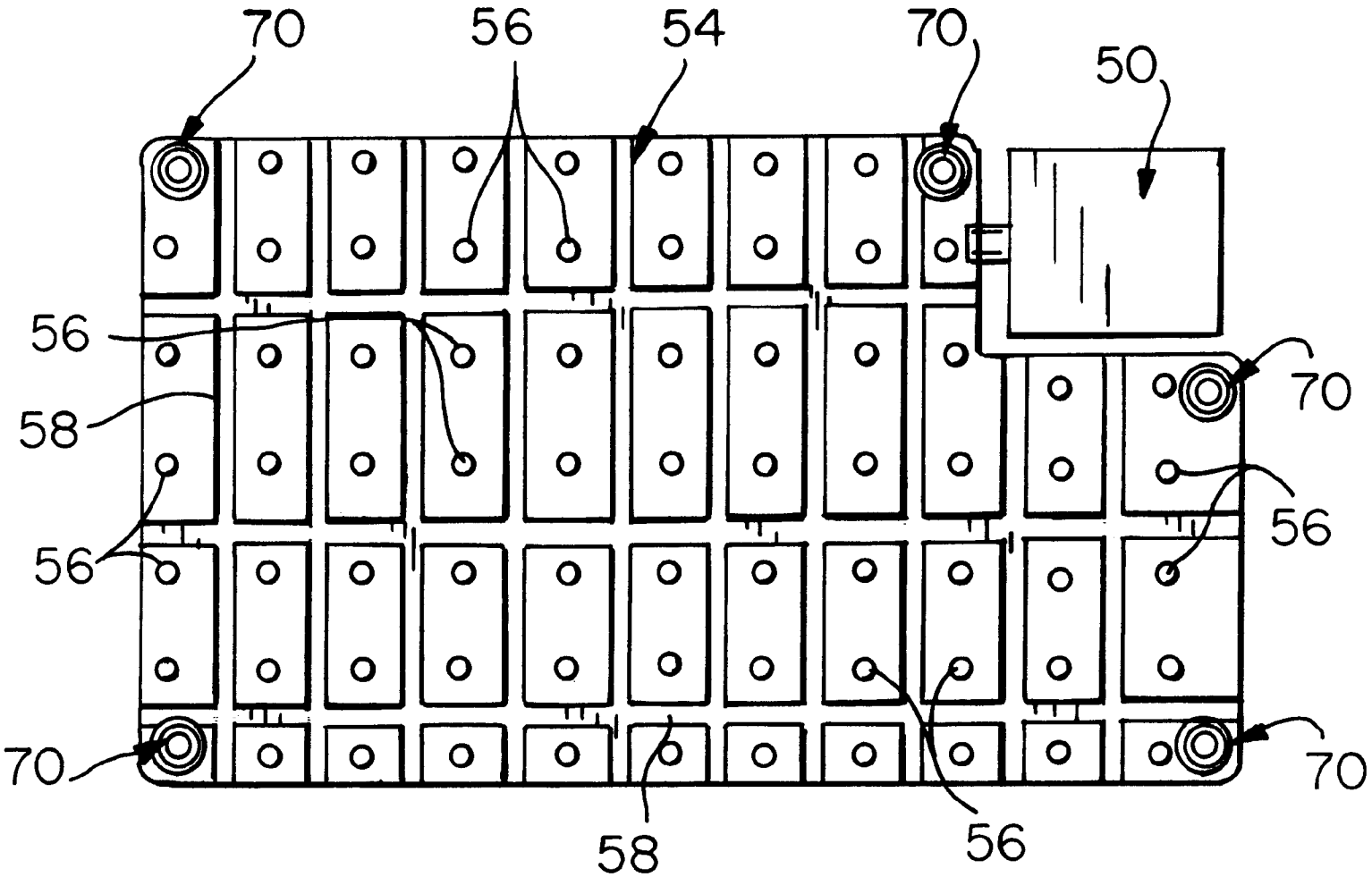
FIG. 4 is a top plan view of a rigid floor of the compressible packing system.

In a relaxed state, the volume of the storage chamber 40 is substantially greater than the volume of the suitcase interior, as best seen in FIGS. 1 and 2. In this manner, a greater packing capacity is provided, enabling the liner to contain a substantially greater quantity of articles 100 than could normally be packed in the interior of the suitcase. Once the storage chamber of the liner is filled with clothing and other compressible articles 100 which are to be packed in the suitcase, the top is sealed closed and a motorized vacuum pump 50 is actuated to remove air from the air tight storage chamber 40. In a preferred embodiment, the motorized vacuum pump 50 is fitted within the suitcase so that an intake 51 of the vacuum pump communicates with an air space 52 below a rigid floor 54. To permit air flow throughout the storage chamber to the intake, the rigid floor is provided with a plurality of air holes 56 in spaced array throughout the floor 54 and communicating between the storage chamber 40 and the air space 52 below the floor, as seen in FIGS. 1 and 4. Ribs 58 or other upwardly projecting structure support the clothing and other articles 100 above the surface of the floor 54 to avoid blocking the air holes 56. An outlet 60 of the vacuum pump is directed through the side of the suitcase, in air flow communication with an exterior of the suitcase, so that air withdrawn from the interior storage chamber is exhausted to atmosphere. A one-way check valve 62 is provided to prevent re-entry of air from atmosphere into the storage chamber, thereby maintaining a negative pressure condition within the liner once air has been exhausted therefrom.

As the air is withdrawn from the liner, the liner begins to collapse. To facilitate a more uniform, downward collapsing of the liner, telescoping leg members 70 may be provided at spaced intervals about the perimeter of the liner. Specifically, the telescoping leg members include a plurality of telescoping extensions 72, 73, 74 extending up from a bottom of the suitcase, with an uppermost one 74 of the telescoping extensions being fitted to the rigid plate 29 on the top 28 of the liner. In this manner, as the air is exhausted by the vacuum pump, the telescoping leg members retract, while guiding the rigid top plate downwardly in a substantially level, uniform manner, until the telescoping leg members reach the fully retracted position, with the top plate substantially level to permit closing of the suitcase, as seen in FIG. 3. In the fully collapsed position, as seen in FIG. 3, the volume of the storage chamber is substantially reduced, as compared to the relaxed position in FIG. 2, thereby compressing the articles contained therein.

Figure 5:
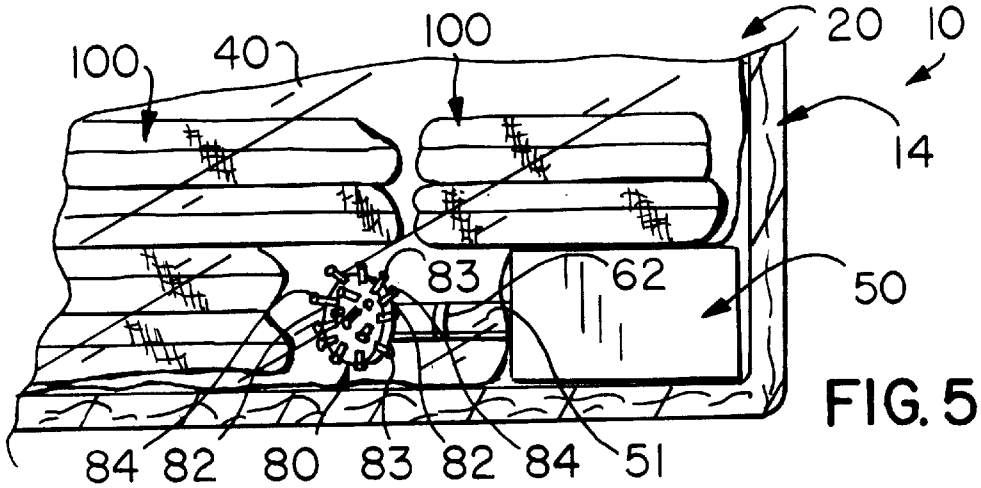
FIG. 5 is an isolated view, in partial section, showing a motorized vacuum pump, one-way valve and air intake fitting in accordance with one preferred embodiment of the invention.

In another embodiment of the invention, shown in FIG. 5, the vacuum motor pump 50 is fitted in a bottom of the suitcase 10, exterior of the liner 22, with the intake 51 of the vacuum pump extending through the side wall 24 of the liner and into the storage chamber 40. An air tight seal is provided on the wall of the liner surrounding the intake 51 to maintain the air tight integrity of the interior storage chamber. The end of the intake 51, within the storage chamber, is provided with a fitting 80 having a plurality of prongs or spokes 82 extending outwardly in multiple directions, similar to a hairbrush. The ends of the prongs may be provided with enlarged heads 83 to prevent the prongs from snagging fabric, such as clothing. The fitting is further provided with a plurality of air intake openings 84 about its surface. The prongs 82 serve to maintain the articles 100 in spaced relation from the air intake openings 84, preventing obstruction of the air intake openings upon operation of the vacuum motor pump 50 to withdraw air from the interior storage chamber 40 of the liner. The intake conduit 51 extending between the fitting 80 and the vacuum pump 50 may be provided with a one-way check valve 62, to prevent air from re-entering the interior storage chamber once exhausted therefrom. Similar to the embodiment described in FIGS. 1–3, the vacuum motor pump includes an outlet directed through the suitcase wall, and communicating with an exterior of the suitcase for exhausting air withdrawn from the liner to atmosphere. In the embodiment shown in FIGS. 5 and 7, the liner is provided with a flexible top 28, sides 24, and bottom 26. When the liner is packed and the top is sealed closed, operation of the vacuum motor pump serves to collapse the liner to a reduced volume, similar to that as seen in FIG. 3, thereby enabling the suitcase to be closed.

While this invention has been shown and described in connection with practical and preferred embodiments thereof, it is recognized that departures may be made from the instant disclosure which, therefore, should not be limited except within the spirit of the following claims as interpreted under the doctrine of equivalents.

What is claimed is:

1. A suitcase comprising:

an upper portion including upper side walls, a top panel and a peripheral edge zone formed about said upper side walls, and a lower portion including lower side walls, a bottom panel and a peripheral edge zone formed about said lower side walls, said upper and lower portions hinged together and structured and disposed to be closed so that said peripheral edge zones are disposed in adjacent relation to enclose an interior packing space surrounded by said upper and lower side walls, said top panel and said bottom panel;

closure means on said peripheral edge zones for releasably securing said upper and lower portions closed;

compressible packing means for containing articles carried in the suitcase and comprising:

a liner formed of a flexible, impervious film material and including sides, a bottom, and a top surrounding an interior storage chamber, access means for opening said liner in order to insert and remove articles from the storage chamber, and seal means for providing an air tight seal about said access means to thereby maintain said interior storage chamber air tight when said access means is closed; and said liner being structured and disposed to collapse from a relaxed state, defined by said packing chamber having a maximum volume, to a collapsed state, defined by said storage chamber having a minimum volume, upon removal of air from said storage chamber, and said storage chamber, when in said collapsed state, being sized and configured to fit within said interior packing space of the suitcase with said upper and lower portions secured closed.

2. The suitcase as recited in claim 1 wherein said access means includes an opening formed in said liner defined by opposing, interlocking edges being separable to facilitate access to said interior storage chamber.

3. The suitcase as recited in claim 2 wherein said interlocking edges include a protruding ridge on one of said edges and a congruently configured channel formed along the opposing edge, said ridge being structured and configured for interlocking, sealing engagement within said channel to thereby provide an air tight seal about the mating, opposing edges of said access means, thereby maintaining said interior storage chamber air tight.

4. The suitcase as recited in claim 1 further including exhaust means for directing air flow from within said storage chamber to an exterior of said liner when removing air from said storage chamber to collapse said liner.

5. The suitcase as recited in claim 4 wherein said exhaust means includes a conduit extending from said storage chamber to an exterior of said liner.

6. The suitcase as recited in claim 4 wherein said exhaust means includes a rigid floor within said liner separating said storage chamber from an air flow channel below said rigid floor, and said floor including a plurality of air holes formed therein to permit air flow from said storage chamber to said air flow channel.

7. The suitcase as recited in claim 4 further including means for spacing the articles contained in said storage chamber from said exhaust means to prevent interruption of air flow therethrough when removing air from said storage chamber.

8. The suitcase as recited in claim 7 wherein said spacing means includes an air intake fitting including a plurality of air holes formed therethrough in air flow communication with said exhaust means and a plurality of spokes extending therefrom, each of said plurality of spokes including an enlarged head on an end thereof for engaging the articles contained in the storage chamber, and said prongs holding the articles away from said air holes to prevent obstruction of the air flow therethrough.

9. The suitcase as recited in claim 7 wherein said spacing means includes a plurality of ribs protruding upwardly from said rigid floor, said ribs being structured and disposed to engage and support the articles contained in said storage chamber to thereby prevent obstructing air flow through said air holes formed in said floor.

10. The suitcase as recited in claim 4 further including vacuum means communicating with said exhaust means for creating said air flow to remove air from said storage chamber.

11. The suitcase as recited in claim 10 wherein said vacuum means includes a vacuum pump interconnected in air flow communication with said exhaust means.

12. The suitcase as recited in claim 11 further including check valve means for preventing entry of air from an exterior of said liner through said exhaust means and into said storage chamber to thereby maintain said liner in said collapsed state once air has been removed from said storage chamber.

13. The suitcase as recited in claim 1 further including stabilizing means for promoting uniform, stabilized collapsing of said liner from said relaxed state to said collapsed state to thereby reduce said volume of said storage chamber and maintaining a uniform configuration of said liner when in said collapsed state so that said upper and lower portions of said suitcase can be secured closed.

14. The suitcase as recited in claim 13 wherein said stabilizing means includes a rigid plate member at said top of said liner and a plurality of telescoping leg members extending upwardly from a bottom of said liner and interconnecting to said rigid plate.

* * * * *